US009796007B2

(12) United States Patent
Frobose

(10) Patent No.: US 9,796,007 B2
(45) Date of Patent: Oct. 24, 2017

(54) COLD PILGER ROLLING MILL AND METHOD FOR FORMING A HOLLOW SHELL INTO A TUBE

(71) Applicant: SANDVIK MATERIALS TECHNOLOGY DEUTSCHLAND GMBH, Dusseldorf (DE)

(72) Inventor: Thomas Frobose, Versmold (DE)

(73) Assignee: SANDVIK MATERIALS TECHNOLOGY DEUTSCHLAND GMBH, Dusseldorf (DE)

( * ) Notice: Subject to any disclaimer, the term of this patent is extended or adjusted under 35 U.S.C. 154(b) by 0 days.

(21) Appl. No.: 15/035,572

(22) PCT Filed: Nov. 4, 2014

(86) PCT No.: PCT/EP2014/073622
§ 371 (c)(1),
(2) Date: May 10, 2016

(87) PCT Pub. No.: WO2015/067576
PCT Pub. Date: May 14, 2015

(65) Prior Publication Data

US 2016/0288180 A1 Oct. 6, 2016

(30) Foreign Application Priority Data

Nov. 11, 2013 (DE) ..... 10 2013 112 371

(51) Int. Cl.
*B21B 21/00* (2006.01)
*B21B 21/04* (2006.01)

(52) U.S. Cl.
CPC ..... *B21B 21/005* (2013.01); *B21B 21/045* (2013.01)

(58) Field of Classification Search
CPC ..... B21B 21/00; B21B 21/04; B21B 21/045; B21B 21/005
See application file for complete search history.

(56) References Cited

U.S. PATENT DOCUMENTS

| | | | | |
|---|---|---|---|---|
| 2,387,515 | A | 10/1945 | Inslee | |
| 4,052,898 | A | 10/1977 | Miller et al. | |
| 2012/0234072 | A1* | 9/2012 | Frobose | B21B 21/005 72/372 |

FOREIGN PATENT DOCUMENTS

| | | | |
|---|---|---|---|
| CN | 2094252 | U | 1/1992 |
| CN | 201192694 | Y | 2/2009 |
| DE | 2359464 | B2 | 8/1979 |
| DE | 4018104 | A1 | 12/1991 |

(Continued)

*Primary Examiner* — Teresa M Ekiert
(74) *Attorney, Agent, or Firm* — Corinne Gorski

(57) ABSTRACT

A cold pilger rolling mill includes a pair of rolls rotatably attached to a roll stand, a crank drive on a driveshaft, which is rotatably mounted around a rotation axis, with a counterweight attached to the crank drive at a radial distance from the rotation axis, and a push rod with a first and a second end. The first end of the push rod is rotatably attached on the crank drive wherein, during the operation of the mill, a rotation of the crank drive is converted into a translation movement of the roll stand between a first and a second reversal position. The radial distance of the first end of the push rod from the rotation axis is adjustable, so that the distance between the two reversal positions of the translation movement of the roll stand is adjustable.

14 Claims, 4 Drawing Sheets

(56) References Cited

FOREIGN PATENT DOCUMENTS

Figure 1:
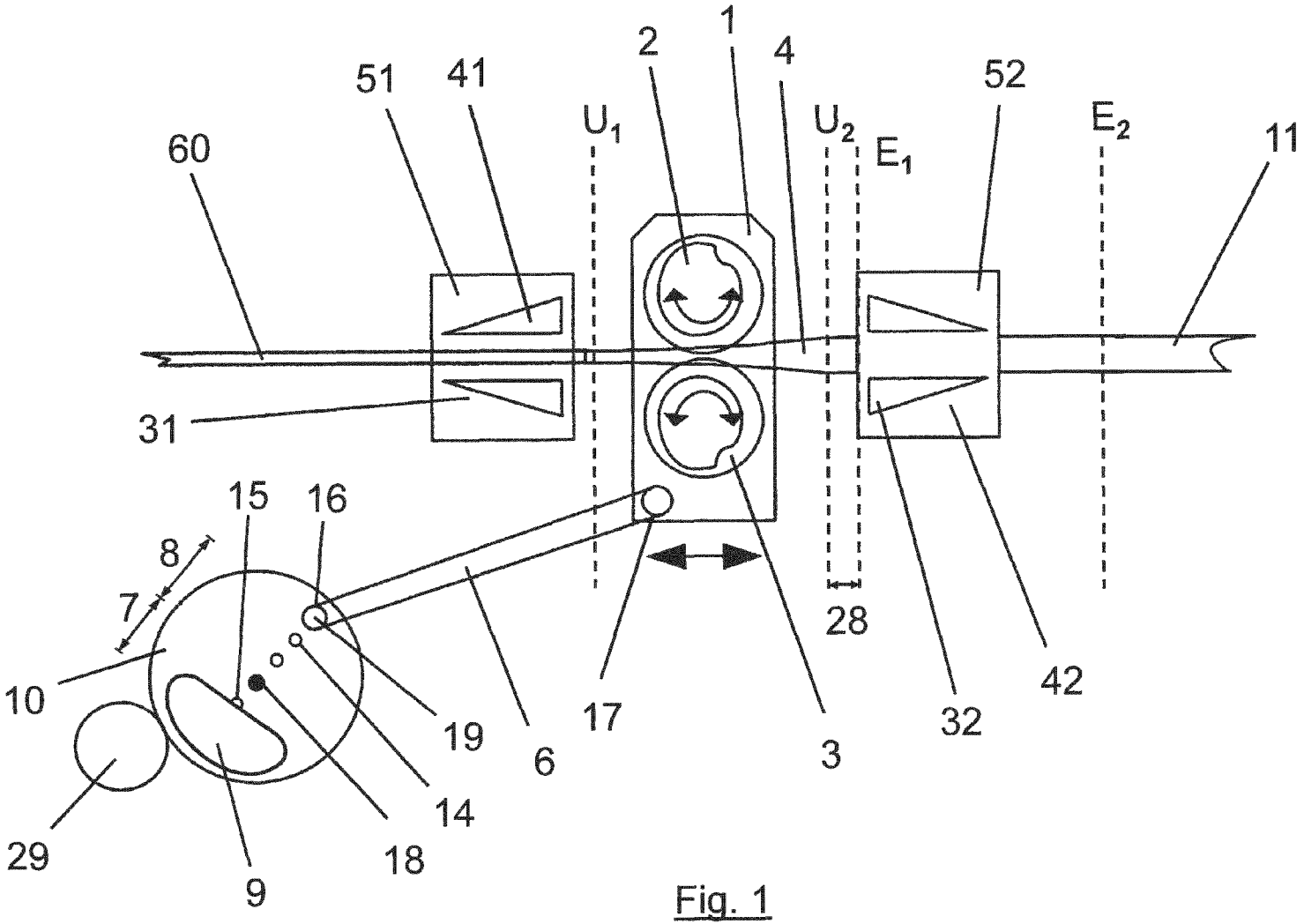

| | | | |
|---|---|---|---|
| DE | 19750787 | C1 | 10/1998 |
| EP | 0524711 | B1 | 10/1994 |
| EP | 2489445 | A1 | 8/2012 |
| GB | 648919 | A | 1/1951 |

* cited by examiner

COLD PILGER ROLLING MILL AND METHOD FOR FORMING A HOLLOW SHELL INTO A TUBE

RELATED APPLICATION DATA

This application is a §371 National Stage Application of PCT International Application No. PCT/EP2014/073622 filed Nov. 4, 2014 claiming priority of DE Application No. 102013112371.6, filed Nov. 11, 2013.

The present invention relates to a cold pilger rolling mill for forming a hollow shell into a tube, with a pair of rolls which are rotatably attached to a roll stand, and with a rolling mandrel as tool, a feeding clamping carriage for receiving the hollow shell, wherein the feeding clamping carriage, during the operation of the mill, can be moved between a first and a second extreme position in such a manner that the hollow shell moves stepwise in the direction towards the tool, with a crank drive which is rotatably mounted around a rotation axis on a drive shaft, with a counterweight attached at a radial distance from the rotation axis on the crank drive, and with a push rod with a first end and a second end, wherein the first end of the push rod is attached rotatably at a radial distance from the rotation axis around a crank pin on the crank drive, and wherein the second end of the push rod is attached to the roll stand, so that, during the operation of the mill, a rotation of the crank drive is converted into a translation movement of the roll stand between a first and a second reversal position.

The invention further relates to a method for forming a hollow shell into a tube, which comprises at least the following steps:

providing a cold pilger rolling mill with a pair of rolls which are rotatably attached to a roll stand, and with a rolling mandrel as tool as well as with a feeding clamping carriage with the hollow shell received thereon, moving the feeding clamping carriage between a first and a second extreme position, in such a manner that the hollow shell moves stepwise in the direction toward the tool, forming the hollow shell into a tube using the tool, wherein a rotation of a crank drive is converted into a translation movement of the roll stand between a first and a second reversal position, wherein the crank drive is rotatably mounted around a rotation axis on a driveshaft, and wherein a counterweight is attached at a radial distance from the rotation axis on the crank drive, and wherein a push with a first end and a second end rod is arranged so that the first end of the push rod is rotatably attached at a radial distance from the rotation axis around a crank pin on the crank drive and the second end of the push rod on is attached to the roll stand.

For the production of precise metal tubes, in particular made from stainless steel, a tubular or hollow cylindrical blank expanded in a longitudinal direction is used, which is reduced by compressive stresses. In the process, a pressure is exerted from outside and from inside on the blank, which leads to a reduction of its outer diameter and its wall thickness. In this manner, a forming of the blank into a tube with defined outer diameter and defined wall thickness occurs.

In the reduction method that is by far the most commonly used for tubes, the blank, also referred to as a hollow shell, is subjected in a completely cooled state to cold reduction by compressive stresses. This method is referred to as cold pilgering. In the process, the hollow shell is shifted over a calibrated rolling mandrel, i.e., a rolling mandrel that has at least in some sections the inner diameter of the finished tube, and it is gripped from outside by means of two calibrated rolls, i.e., rolls that define the outer diameter of the finished tube, and rolled in the longitudinal direction over the rolling mandrel.

During the cold pilgering, the hollow shell undergoes a stepwise advance in the direction toward the rolling mandrel and over and past said rolling mandrel. Between two feeding steps, the rolls are moved as they rotate in a direction parallel to the axis of the rolling mandrel over the mandrel and thus over the hollow shell, in the process of which they roll the hollow shell. The horizontal movement of the rolls is predetermined by a roll stand on which the rolls are rotatably mounted and which is moved back and forth between two reversal points in a direction parallel to the axis of the rolling mandrel. At each reversal point of the roll stand, the rolls release the hollow shell and this hollow shell is pushed ahead by an additional step in the direction toward the tool. At the same time, the hollow shell undergoes a rotation about its axis, in order to achieve a uniform shape of the finished tube. The two calibrated rolls of the roll stand are arranged one above the other, so that the hollow shell is passed through between them. The so-called pilger-mouth formed by the rolls grips the hollow shell, and the rolls push off a small wave of material outward. This wave of material is stretched out by the smoothing pass of the rolls and by the rolling mandrel to the intended wall thickness, until the idle pass of the rolls releases the finished tube.

By repeatedly rolling each tube section, a uniform wall thickness and roundness of the tube as well as a uniform inner and outer diameter are achieved.

In cold pilger rolling mills, the roll stand with the two rolls is moved back and forth by means of a crank drive in a direction parallel to the axis of the rolling mandrel. The rolls themselves are set in rotation in general by means of a rack that is stationary relative to the roll stand, rack with which toothed wheels that are firmly connected to the axle of the rolls engage.

The feeding of the hollow shell over the mandrel occurs by means of one or more feeding clamping carriages driven in translation movement, the carriage performing a translation movement in a direction parallel to the axis of the rolling mandrel and transfers it to the hollow shell.

During the rolling, i.e., the movement of the roll stand with the rotating rolls over the hollow shell, the feeding clamping carriage(s) is (are) substantially stationary and they take up the forces transferred by the tool, i.e., the rolls and the rolling mandrel, to the hollow shell.

In order to hold the hollow shell and to be able to move it in a translation movement onto the rolling mandrel and set it in rotation around the rolling mandrel, the feeding clamping carriage(s) comprise(s) a chuck by means of which the hollow shell is held between clamping jaws.

For the production of precise finished tubes, a precise and controlled stepwise advance of the feeding clamping carriage and also a precise and controlled translation movement of the roll stand are absolutely required.

Known cold pilger rolling mills in each case allow only the rolling of tubes having a single tube diameter as well as a single wall thickness of the tube, which is predetermined by the respective rolling mandrel. For the production of tubes of different type, mills of different design and calibration are thus required. On the other hand, if the same cold pilger rolling mill is to be used to roll tubes of different type, then the conversion of production to another tube with a different diameter and/or a different wall thickness requires an expensive retrofitting of the entire mill.

On this background, the object of the present invention is to provide a cold pilger rolling mill by means of which tubes of different type can be rolled at low retrofitting cost.

This object is achieved according to the invention in that, in the cold pilger rolling mill, the radial distance between the first end of the push rod and the rotation axis is adjustable, so that the distance between the two reversal positions of the translation movement of the roll stand is adjustable.

The roll pair of the roll stand, during the cold pilgering, when it grips the hollow shell, pushes off a small wave of material from the outside. This wave of material is stretched out by a smoothing pass of the rolls and by the rolling mandrel to the intended wall thickness of the tube. This process is terminated when the idle pass of the rolls releases the finished tube. The extent of the wave of material depends on the ratio between the dimensioning of the cylindrical hollow shell and the tube diameter to be achieved and on the wall thickness of the tube to be achieved. In addition, the extent of the wave of material generated depends on the stroke of the roll stand, i.e., on the distance covered by the roll stand in the process of its translation movement from a first reversal position to a second reversal position.

Thus, for producing a tube with defined tube diameter and defined wall thickness, it is advantageous to use a cold pilger rolling mill whose roll stand stroke is adapted precisely to the tube dimensions to be achieved. Otherwise there is the risk that the wave of material pushed off during the course of the rolling becomes excessively large and the resistance generated thereby affects the rolling process and the result achieved or even brings the entire process to a halt.

A switch to another mill or an expensive retrofitting of the same mill for the purpose of adapting the roll stand stroke can be avoided if the cold pilger rolling mill offers the possibility of adapting the roll stand stroke in accordance with the tube diameters and wall thicknesses to be achieved. According to the invention, it is proposed to design the position of the push rod on the crank drive so that it can be adjusted. By changing the radial distance between the first end of the push rod and the rotation axis of the crank drive, the stroke, i.e., the distance covered by the translation movement of the second end of the push rod in a direction parallel to the axis of the rolling mandrel can be adjusted, which in turn thus establishes the roll stand stroke. Thus, a possibility is given to adapt the mill, in a rapid and cost effective manner, for the production of tubes of different type.

Here, it is advantageous for the crank drive to also comprise one or more counterweights, which, like the crank pin, are spaced at a distance from the rotation axis of the crank drive. It is particularly advantageous for this counterweight to be arranged with an offset from the crank pin of approximately 180° relative to the rotation axis.

The horizontal forward and backward movement of the roll stand in a direction parallel to the axis of the rolling mandrel is achieved by means of a crank drive. Here, the crank drive consists of a crankshaft which can be rotated about a rotation axis, and which has a crank pin that is radially spaced from the rotation axis. For the conversion of the rotation of the cranke drive into a translation movement of the roll stand, a push rod with a first end and with a second end is provided. The push rod is pivotably connected by articulation at its first end to the crank pin of the crankshaft, and it is pivotably connected by articulation on its second end to the roll stand.

The horizontal movement direction of the roll stand parallel to the axis of the rolling mandrel is established by guide rails. The distance between the crank pin and the rotation axis of the crank drive, more precisely of the crankshaft, establishes the maximum distance covered by the crank pin in the horizontal direction parallel to the axis of the rolling mandrel. This distance corresponds to twice the distance between the crank pin and the rotation axis. If the rotation of the crank pin, in the simplest case, is transferred directly by means of the push rod to the roll stand, then the roll stand translation stroke is equal to the maximum distance covered by the crank pin in the horizontal direction parallel to the axis of the rolling mandrel. By changing the distance between the crank pin and the rotation axis of the crank drive, the roll stand stroke can thus be adjusted directly and adapted to the tube type to be produced. In the case of a transfer of the rotation of the crank drive to the roll stand by means of a more expensive mechanical system as well, which comprises more moving parts than just the push rod, the roll stand is at least dependent on the distance between the crank pin and the rotation axis of the crank drive.

The term crankshaft, in the sense of the present application, refers to any type of shaft with a crank pin arranged concentrically thereon for receiving the push rod. In particular, in the sense of the present application, a crankshaft denotes a conventional construction with rotatably mounted shaft pins, which define the rotation axis, and with one or more crank webs connecting the shaft pins and the crank pins. However, in the sense of the present application, the term crankshaft, in addition, denotes in particular a crank wheel or flywheel, which is pivotably mounted on an axle, wherein, on the wheel itself, the crank pin is attached concentrically relative to the rotation axis.

Such a design of the crankshaft as a flywheel has a number of advantages. On the one hand, the installation and maintenance are clearly facilitated, and, on the other hand, by means of a crankshaft designed as a flywheel, the crankshaft can be used as an additional flywheel weight, which ensures a better smoothness of running of the roll stand.

The crank drive is driven advantageously by a torque or a hollow shaft motor. Here, the crankshaft, for example, a flywheel, can be driven directly, i.e., without transmission, as a result of which friction losses and wear phenomena are reduced.

In an embodiment, the radial distance between the first end of the push rod and the rotation axis can be adjusted in discrete steps or continuously.

An embodiment in which the radial distance can be adjusted in discrete steps is particularly advantageous if different tubes of standardized type are to be produced using the same cold pilger rolling mill. In this case, the discrete steps are adapted to the respective standards for the tube diameter and the wall thicknesses, so that a wave of a material in a predetermined size range is generated by the rolls, which is adjusted as optimally as possible to the concrete performance data of the mill.

By comparison, a possibility of continuous adjustability is particularly advantageous if very different types, in particular also individual special productions, are to be produced with the same mill. In addition, a continuous adjustability allows the possibility of a precise fine tuning of the roll stand stroke.

In an embodiment, the crank drive has a plurality of sockets for the crank pin for attaching the first end of the push rod, wherein the sockets are arranged at mutually different radial distances relative to the rotation axis.

By means of a plurality of sockets for the crank pin, the relative position of the crank pin relative to the rotation axis can be freely selected in discrete steps in accordance with the radial distances of the sockets.

In an embodiment, the sockets for the crank pin are arranged in radial direction on a straight line.

In an arrangement of the sockets on a straight line, the position of the crank pin along this straight line can be freely selected in discrete steps. If the crank drive also has a counterweight, then, by means of this arrangement, it can be ensured, for example, that even in the case of a change in the position of the crank pin, the counterweight will advantageously continue to remain offset from the crank pin by approximately 180° relative to the rotation axis.

In an embodiment, the distances between adjacent sockets for the crank pin are of identical size.

The distances of identical size between adjacent sockets for the crank pin make it possible to select the setting of the roll stand stroke in discrete steps of identical step length.

In an embodiment, the distances between adjacent sockets for the crank pin are at least partially of different size.

Different distances between adjacent sockets are particularly advantageous if the roll stand stroke needs to be adjustable for tubes of different type, wherein the differences between the respective strokes are not identical. This can be particularly advantageous if the corresponding standards for the tube diameters and the wall thicknesses for the different tube types do not differ from one another in accordance with a linear function.

In an embodiment of the cold pilger rolling mill, the crank drive has a through hole having a cross section that is at least in some sections radially symmetric but not rotationally symmetric for receiving the crank pin, wherein the crank pin is designed so that it comprises a base body with a front side and a back side, a pin section arranged on the front side, and a securing section arranged on the back side, wherein the base body has a cross section which is designed at least in some sections to be complementary to the cross section of the through hole, so that the base body is received in a twist-proof manner and with positive lock in the through hole, wherein the pin section is arranged eccentrically on the base body, so that the pin section can be arranged, by rotating the base body before the introduction into the through hole, at different radial distances from the rotation axis of the crankshaft, wherein the first end of the push rod is attached on the pin section, so that the push rod can be rotated around the longitudinal axis of the pin section, and wherein a securing element is arranged on the securing section, so that the crank pin is secured against being pulled out of the through hole.

In the sense of the present invention, a radial symmetry is a symmetry in which a rotation of the base body by a certain angle around a straight line (rotation axis, symmetry axis) brings the base body back to coincide with itself. In the sense of the present application, this is different from a rotational symmetry, in which a rotation by any desired angle brings an object back to coincide with itself.

The radially symmetric but non-rotationally symmetric design of the base body has the consequence that this base body can only be inserted in a twisted form back into the through hole in discrete steps (after removal from the through hole). In this manner, a twist-proofness of the base body with respect to the crank drive is ensured, in particular.

An eccentric arrangement of the pin section on the base body in this sense means that the pin section does not coincide with the symmetry axis of the base body. Otherwise, a torsion of the base body with respect to the through hole would not result in any change in the distance of the pin section from the rotation axis of the crank drive.

In addition, other corresponding designs of the plan view of the socket and the crank pin are also conceivable, which are mirror symmetric relative to a central axis of the plan view, but not rotationally symmetric relative to a 90° rotation around its center point. A center point in this sense refers to the center of gravity of the plan view area. A central axis in this sense is any straight line through the center of gravity of the plan view area which divides the plan view into two sections of equal area.

Here, in an embodiment, the through hole and the base body of the crank pin are designed at least in some sections with an elliptical cross section.

An elliptical cross section of the socket designed as through hole as well as of the base body of the crank pin has the result that the crank pin can be introduced with only two possible orientations into the socket. These two orientations differ by a 180° rotation of the crank pin around its longitudinal axis. Thus, a socket corresponding to this embodiment with a correspondingly designed crank pin already provides two possible distances of the crank pin, more precisely of the pin section, from the rotation axis of the crank drive. This distance difference results from the distance of the pin section from the minor axis of the ellipse and it is equal to twice the distance from the minor axis. In an embodiment, the pin section is therefore arranged, preferably on the major axis, at a distance from the minor axis of the elliptical cross section.

In a further embodiment, the major axis of the elliptical cross section of the through hole is oriented in radial direction of the crank drive.

It is also possible for the major axis of the elliptical cross section of the through hole to be arranged in another direction than the radial direction. In general, the major axes of individual sockets moreover can also be oriented in a different direction. However, a radial orientation of a socket, i.e., of the major axis of the plan view area thereof or of the minor axis of the plan view area thereof, offers the possibility of the greatest possible variation in the distance of the pin section from the rotation axis of the crank drive. In addition, an identical orientation of the major axes of the individual sockets offers the possibility of a variation of the distances of the pin section from the rotation axis in discrete steps of identical or at least in some cases identical step width.

In a further embodiment, the through hole therefore tapers in axial direction and the base body has a tapering that is complementary thereto.

The tapering of the through hole and a corresponding design of the crank pin, more precisely of its base body, allow a positive lock connection between the through hole and the crank pin, which secures the crank pin against completely moving through the through hole. In addition, in spite of the material lost due to the through hole, the stability of the crank drive remains ensured.

All that remains is the need to secure against being pulled out of the through hole, in order to ensure a stationary fixing of the pin. This can occur by means of any securing elements known in the prior art that can be attached to the securing section. In particular, this can be a securing nut attached by means of a screw connection, a securing screw attached by means of a screw connection, or a securing cotter that is shifted into or onto the securing section.

In an embodiment, the cold pilger rolling mill comprises an attachment device for the detachable attachment of the counterweight.

A change in the distance of the crank pin from the rotation axis of the crank drive leads to a change of the moment of inertia acting on the crank drive, which is generated by the push rod and the roll stand. In order to ensure a uniform running of the oscillating movement of the roll stand and thus ensure high quality of the rolled tube, the goal therefore is to ensure as quiet as possible a running of the crank drive without uncontrolled forces or torques. For this purpose, it is advantageous to attach the counterweight detachably to the crank drive.

Here, in an embodiment, the counterweight can be attached exchangeably to the crankshaft, so that the weight of the counterweight can be varied, i.e., as a function of the position of the crank pin, the counterweight can be exchanged for another counterweight. Or, in an embodiment, the position of the counterweight can be adjusted in reference to its radial distance from the rotation axis of the crank drive and/or in reference to the angular distance from the crank pin, i.e., the same counterweight is kept and only its position on the crank drive is adapted in accordance with the change in position of the crank pin.

Here it is advantageous for the crank drive to be designed as a flywheel and to have a width in the direction parallel to the rotation axis wherein the counterweight is arranged within the width of the flywheel.

In particular, it is advantageous here if the counterweight and the crank pin with the push rod are arranged with mutual distance in the direction of the rotation axis.

In an embodiment, the radial distance of the counterweight from the rotation axis is adjustable, in particular adjustable in discrete steps or continuously.

The adjustability of the position of the counterweight in discrete steps is available in particular to compensate for a corresponding adjustability of the crank pin in discrete steps. By comparison, a continuous adjustability of the counterweight with a corresponding continuous adjustability of the crank pin position is available. In addition, a continuous adjustability is particularly advantageous when a fine tuning of the position of the counterweight is important.

In an embodiment, the crank drive has a plurality of attachment devices for the detachable attachment of the counterweight, wherein the attachment devices are arranged at mutually different radial distances relative to the rotation axis.

A plurality of attachment devices for the detachable attachment of the counterweight makes it possible to be able to freely select in discrete steps the position of the counterweight relative to the rotation axis in accordance with the radial distances of the attachment devices. Here, the attachment devices can in each case consist in particular of one or more sockets for receiving one or more attachment elements, for example, can consist of a through hole with an inner thread into which an attachment screw as attachment element is screwed, or also a threadless through hole into which a rod-shaped attachment element is introduced and secured on both sides against shifting.

In an embodiment, the crank drive is designed in the form of a flywheel.

In an embodiment of the crank drive, more precisely of the crankshaft, as flywheel, the wheel itself can be used as a flywheel weight or as a counterweight (in the case of a corresponding inhomogeneous weight distribution).

In an embodiment, the shortest distance between an extreme position of the feeding clamping carriage and of a reversal position of the roll stand is adjustable by adjusting the extreme position of the feeding clamping carriage.

In the case of a change of the roll stand stroke, a corresponding change of the positioning or arrangement of the feeding clamping carriage, in particular of its extreme positions, can be advantageous in addition. On the one hand, a clear increase in the extent of the roll stand stroke can lead to a risk of collision of the roll stand with an adjacent feeding clamping carriage. This risk can be eliminated by making the position of the feeding clamping carriage adjustable, in particular its extreme position closest to the rolling mandrel. As a result, the relative positioning of this extreme position with respect to the reversal position of the roll stand also changes, in particular the minimum distance between this extreme position and the closest reversal position.

In addition, it is also advantageous for the stability of the tube guide that this minimum distance, i.e., the minimal distance between an extreme position closest to the rolling mandrel and a closest reversal position, is adjustable. If the roll stand stroke is clearly reduced, then this minimum distance is increased accordingly. However, an excessively large minimum distance involves the risk of an undesired deformation of the hollow shell if the feeding clamping carriage during the rolling of the hollow shell now absorbs the forces transmitted by the hollow shell only partially due to the excessively large distance. In addition, in the course of the rolling process, the tube can be set in oscillation, without these oscillations being absorbed sufficiently by the feeding clamping carriage.

In an embodiment, the extreme position is adjustable in discrete steps or continuously.

An adjustability of the extreme position in discrete steps is available in particular in the case of a corresponding adjustability of the roll stand stroke in discrete steps as the result of a corresponding adjustability of the crank pin distance from the rotation axis. A continuous adjustability by comparison is advantageous particularly in the case of a corresponding continuous adjustability of the roll stand stroke. In addition, a continuous adjustability of the extreme position of the feeding clamping carriage is advantageous in particular for a fine tuning of the distances relative to the reversal positions of the roll stand.

The above-mentioned problem is also solved according to the invention by a method for forming a hollow shell into a tube: providing a cold pilger rolling mill with a pair of rolls which are rotatably attached to a roll stand, and with a rolling mandrel as tool, as well as with a feeding clamping carriage with the hollow shell received therein, moving the feeding clamping carriage between a first extreme position and a second extreme position in such a manner that the hollow shell moves stepwise in the direction toward the tool, forming the hollow shell into a tube using the tool, wherein a rotation of a crank drive is converted into a translation movement of the roll stand between a first and a second reversal position, wherein the crank drive is rotatably mounted around a rotation axis on a drive shaft, and a counterweight is attached at a radial distance from the rotation axis on the crank drive, and a push rod with a first and a second end is arranged so that the first end of the push rod is rotatably attached at a radial distance from the rotation axis around a crank pin on the crank drive and the second end of the push rod is attached on the roll stand, wherein the method moreover comprises the step: adjusting the distance between the two reversal positions of the translation movement of the roll stand by adjusting the radial distance of the first end of the push rod from the rotation axis.

In an embodiment of the method, the crank drive in addition has a through hole with a cross section that is at least in some sections radially symmetric but not rotationally symmetric for receiving the crank pin, wherein the crank pin is designed so that it comprises a base body with a front side and a back side, with a pin section arranged on the front side, and with a securing section arranged on the back side, wherein the base body has a cross section which is designed at least in some sections to be complementary to the cross section of the through hole, so that the base body can be received in a twist-proof manner and with positive lock in the through hole, wherein the pin section is arranged eccentrically on the base body, wherein, on the pin section, the first end of the push rod is attached so that the push rod can be rotated around the longitudinal axis of the pin section, wherein, on the securing section, a securing element is arranged so that the crank pin (19) is secured against being pulled out, and wherein the step of the adjustment of the radial distance of the first end of the push rod from the rotation axis comprises the following partial steps: detaching the securing element, pulling the crank pin out of the through hole, rotating the crank pin around the longitudinal axis of the crank pin, reinserting the crank pin into the through hole, and attaching the securing element.

To the extent that aspects of the invention have been described previously with reference to a cold pilger rolling mill, they also apply to the corresponding method for forming a hollow shell into a tube, and vice versa. To the extent that the method is carried out with a cold pilger rolling mill according to this invention, this method comprises the corresponding devices for this purpose. In particular, embodiments of the cold pilger rolling mill are also suitable for carrying out the described embodiments of the method.

Additional advantages, features and application possibilities of the present invention become clear in reference to the following description of preferred embodiments and the associated figures.

Figure 2:
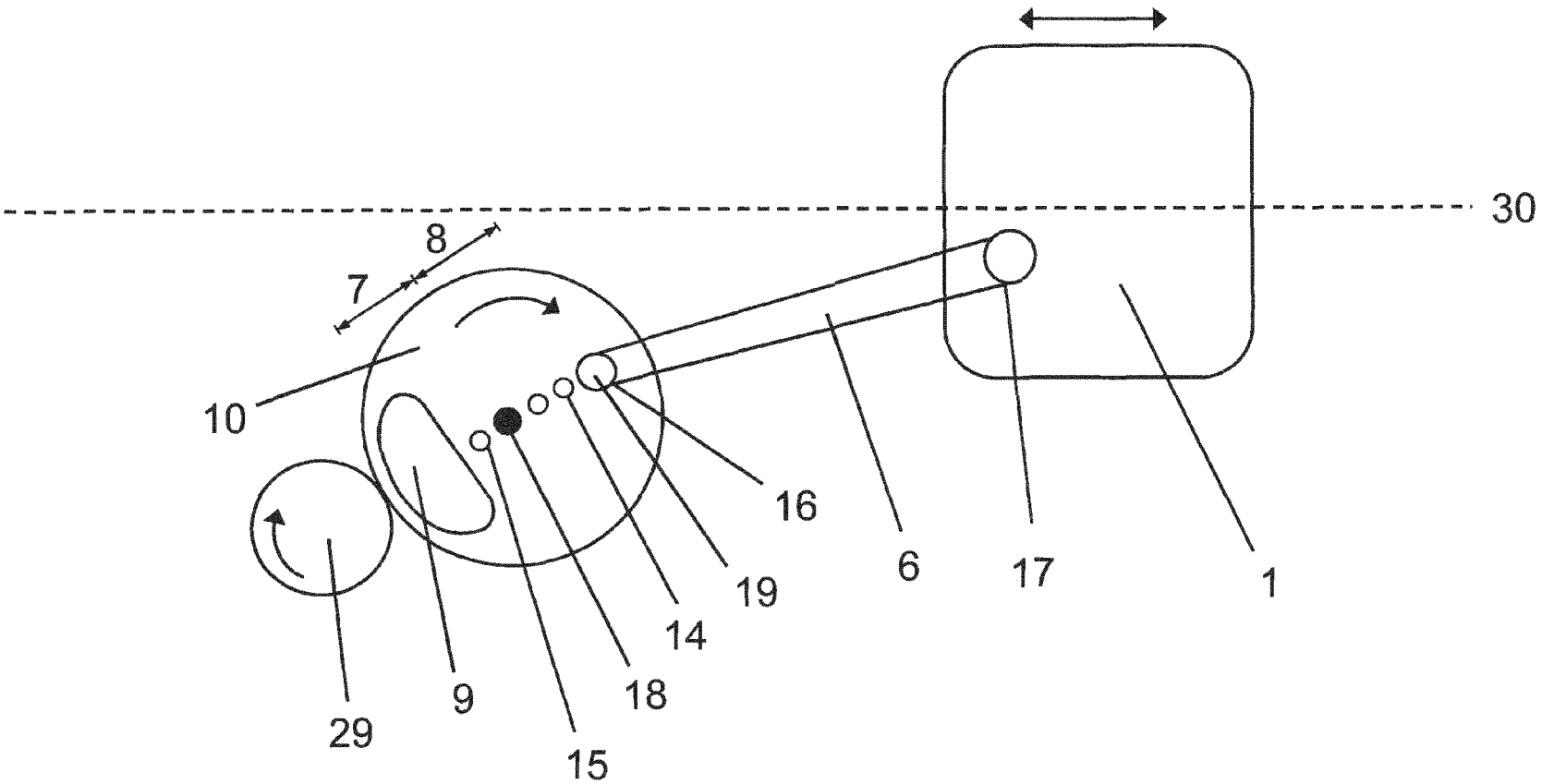
Figure 3:
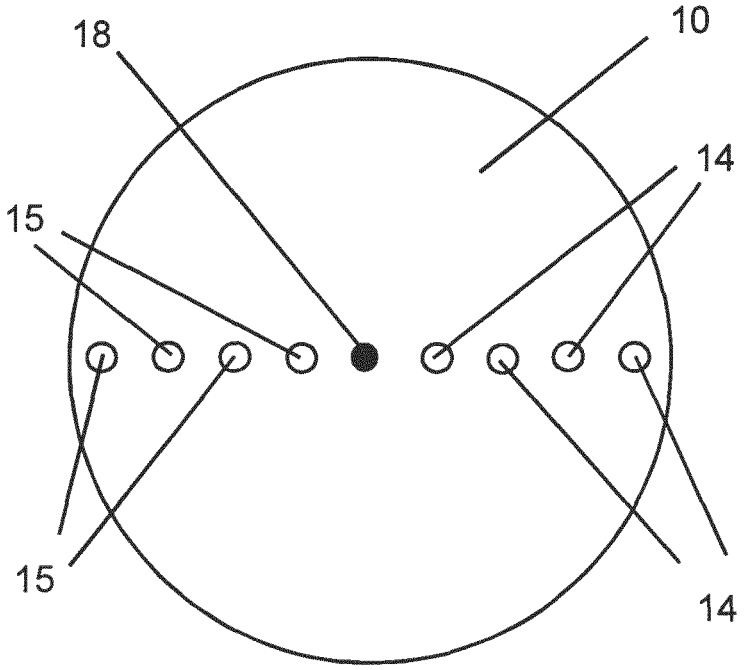
Figure 4A:
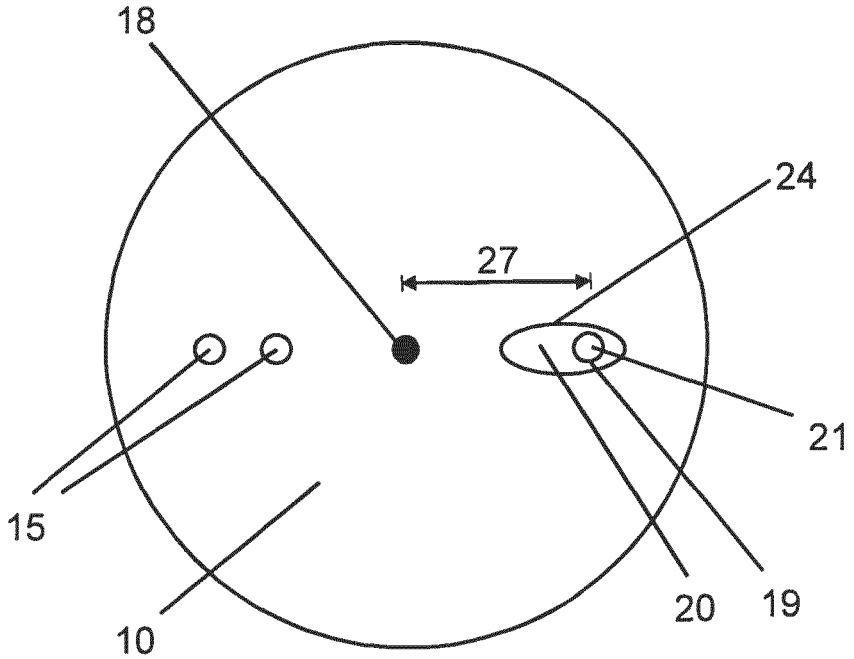
Figure 4B:
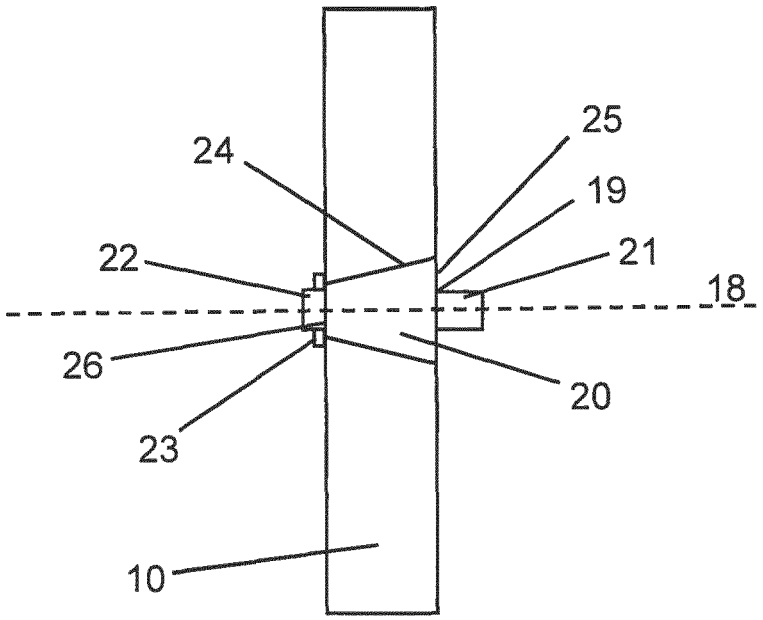

FIG. 1 shows a diagrammatic representation of a cold pilger rolling mill in a side view, FIG. 2 shows a diagrammatic representation of a crank drive according to the invention with drivetrain, push rod and roll stand in a side view, FIG. 3 shows a diagrammatic representation of a flywheel according to the invention in a view in the direction of the rotation axis, and FIGS. 4*a* and 4*b* show diagrammatic representations of a flywheel with elliptical crank pin in a view in direction of the rotation axis and as a cross-sectional view.

FIG. 1 diagrammatically shows the structure of the cold pilger rolling mill in a side view. The rolling mill comprises a roll stand 1 with two rolls 2, 3, a calibrated rolling mandrel 4 as well as, in the embodiment depicted, two clamping devices 31, 32 each with a chuck 41, 42, wherein the clamping jaw means of the chuck in each case are formed in the shape of a wedge. The rolls 2, 3 together with the rolling mandrel 4 form the tool of the cold pilger rolling mill in the sense of the present application. It should be noted that, in FIG. 1, reference numeral 4 marks the position of the rolling mandrel, which in fact cannot be seen, within the hollow shell 11.

The chucks 41, 42 are substantially identical and they differ only in the dimensioning of their clamping jaw supports, which are dimensioned so that they can clamp different nominal diameters.

The chuck 42 mounted on the feeding clamping carriage 52 clamps the hollow shell 11 in front of the roll stand 1 as an inlet chuck and ensures the feeding of the hollow shell 11 over the rolling mandrel 4. The feeding device 51 with chuck 41 as outlet chuck receives the tube 60 that has been completely reduced and pushes it out of the mill.

During the cold pilger rolling on the rolling mill shown in FIG. 1, the hollow shell 11, driven by the feeding clamping carriage 52, undergoes a stepwise feeding in the direction toward the rolling mandrel 4 and over and past the latter. The rolls 2, 3 are moved horizontally back and forth over the mandrel 4 and thus over the hollow shell 11. Here, the horizontal movement of the rolls 2, 3 in a direction parallel to the axis of the rolling mandrel 4 is predetermined by the roll stand 1 on which the rolls 2, 3 are rotatably mounted. The roll stand 1 is moved back and forth by means of a crank drive 10 via a push rod 6 in a direction parallel to the axis of the rolling mandrel 4. The rolls 2, 3 themselves are set in rotation here by a rack (not shown) which is stationary relative to the roll stand 1, and with which toothed wheels (not shown) firmly connected to the roll axles engage. The push rod 6 has a first end 16 rotatably arranged on the crank drive 10 and a second end 17 rotatably arranged on the roll stand 1. The crank drive 10, more precisely the crankshaft, is in the form of a flywheel in the embodiment depicted. On the flywheel 10, a driving wheel 29 is arranged, which in turn is driven by a torque motor (not shown) and thus sets the flywheel 10 in rotation.

The crank pin 19 is detachably attached to the flywheel 10 in a socket 14. The flywheel 10 has a plurality of such sockets 14 arranged on a straight line. Thus, the distance 8 of the crank pins 19, and thereby of the first end 16 of the push rod 6, from the rotation axis 18 of the flywheel 10 can be freely selected in discrete steps. In addition, the flywheel also has a plurality of sockets arranged radially on a straight line and used as attachment devices 15. By means of these attachment devices 15, one or more counterweights 9 can be detachably attached to the flywheel 10. Thus, in the embodiment depicted, the distance 7 of the counterweight 9 from the rotation axis 18 of the flywheel 10 can also be freely selected in discrete steps.

The feeding of the hollow shell 11 over the mandrel 4 occurs in each case at the reversal points $U_1$, $U_2$ of the roll stand 1 by means of the feeding clamping carriage 52, which grips the hollow shell 11 by means of the chuck 42 and allows a translation movement in a direction parallel to the axis of the rolling mandrel 4. Here, the feeding carriage moves back and forth between two extreme positions $E_1$, $E_2$. The roll stand 1 has two rolls 2, 3, wherein the two rolls 2, 3 arranged one above the other form the so-called pilgering mouth and they firmly secure the tube central axis of the tube 60 to be rolled between themselves. The rotation axis 18 of the flywheel 10 is arranged under the tube central axis. The two calibrated rolls 2, 3 in the roll stand 1 rotate against the feeding direction of the feeding clamping carriage 52. The pilgering mouth formed by the rolls grips the hollow shell 11, and the rolls 2, 3 push off a small wave of material from the outside, which is stretched out by a smoothing pass of the rolls 2, 3 and by the rolling mandrel 4 to the intended wall thickness, until an idle pass of the rolls 2, 3 releases the finished tube 60 again. During the rolling, the roll stand 1 moves with the rolls 2, 3 attached thereto against the feeding direction of the hollow shell 11.

By means of the feeding clamping carriage 52, the hollow shell 11 is pushed forward, after achievement of the idle pass of the rolls 2, 3, by an additional step onto the rolling mandrel 4. The rolls 2, 3 return with the roll stand 1 into their horizontal starting position. At the same time, the hollow shell 11 undergoes a rotation about its axis, in order to achieve a uniform shape of the finished tube 60. By rolling each tube section several times, a uniform wall thickness and roundness of the tube 60 as well as uniform inner and outer diameters are achieved.

FIG. 2 shows an embodiment of a drive unit (6, 10, 29) according to the invention for the roll stand 1 of a cold pilger rolling mill in a diagrammatic detailed view from the side.

The roll stand 1 of the cold pilger rolling mill is driven in such a manner that it moves back and forth oscillating linearly in a movement direction parallel to the axis of the rolling mandrel 4. For the generation of such a linearly oscillating movement of the rolling stand 1, a crank drive 10 is used, which consists of a crankshaft to which a push rod 6 is attached. The push rod 6 has a first and second end 16, 17. In the represented embodiment, the crankshaft is formed as flywheel 10, which can be rotated around a rotation axis 18.

On the flywheel 10, a crank pin 19 is attached eccentrically, on which, in turn, a push rod 6 is pivotably arranged by means of a bearing. While the first end 16 of the push rod 6 is thereby fixed to the flywheel 10 or the crank pin 19 thereof, the second end 17 of the push rod 6 is pivotably attached to the roll stand 1 by means of a bearing. In this manner, a rotation of the flywheel 10 leads to a linearly oscillating movement of the roll stand 1 in the movement direction 3 parallel to the axis of the rolling mandrel. The flywheel 10 in addition has a rotationally symmetric weight distribution, which is the result of the eccentric attachment of a counterweight 9 to the flywheel 10.

The crank pin 19 is detachably attached in a socket 14 to the flywheel 10. Here, the flywheel 10 has a plurality of sockets 14 arranged radially on a straight line, so that the distance 8 of the crank pins 19 and thereby of the first end 16 of the push rod 6 from the rotation axis 18 of the flywheel 10 can be freely selected in discrete steps. Similarly, the flywheel comprises a plurality of attachment devices 15, in the form of sockets, which are arranged radially on a straight line, and by means of which one or more counterweights 9 can be detachably attached to the fly 10. In this way, in the represented embodiment, the distance 7 of the counterweight 9 from the rotation axis 18 of the flywheel 10 can be freely selected in discrete steps.

The flywheel 10 is designed as a toothed wheel in the represented embodiment. This toothed wheel engages with a driving wheel 29, which in turn is driven by a torque motor (not shown) and in this way sets the flywheel 10 in rotation.

The rolls received in the roll stand 1 define the position of the central axis 30 of the tube 60 to be rolled. The selected construction has the general advantage that the closeness of the rotation axis 18 of the flywheel 4 to the central axis 16 of the tube 60 makes it possible to implement a comparatively obtuse angle between the push rod 6 and the translation direction 3 of the roll stand 1. This leads to a more uniform running of the roll stand 1 and thereby to less wear of its guide elements.

FIG. 3 shows a diagrammatic view of a flywheel 10 as crank drive from the front, i.e., in the direction of the rotation axis 18, which comprises a plurality of sockets 14 for the detachable attachment of the crank pin 19 to the flywheel 10. The flywheel 10 is rotationally symmetric relative to its rotation axis 18. The sockets 14 for the crank pin 19 are arranged in discrete steps with identical step lengths radially along a straight line. Offset by 180° relative to the rotation axis 18, an additional plurality of attachment devices 15 in the form of sockets are arranged. These attachment devices 15 are used for the attachment of a counterweight 9 to the flywheel. In general, it would also be conceivable to attach several counterweights 9 to different attachment devices 15. The attachment devices 15 are arranged in a distribution radially along a straight line in discrete steps with identical step widths.

By means of the represented embodiment of a flywheel 10 according to the invention, the distance 8 of the crank pin 19 and thus of the first end of the push rod 6 from the rotation axis 18 of the crank drive 10 can be varied in a simple and cost effective manner in discrete steps with identical step width. Thus, the stroke of the roll stand 1 is also varied in a corresponding manner in discrete steps with identical step width. If the position change is not transferred directly to the roll stand 1, as is the case in the embodiments of the cold pilger rolling mill according to the invention shown in FIGS. 1 and 2, then, depending on the design of the transmission mechanics, a variation of the crank pin position with identical step widths can also result in a variation of the roll stand stroke with non-identical step widths.

In FIG. 4*a*, the embodiment according to the invention of a flywheel 10 in a view in the direction of the rotation axis 18 can be seen. The flywheel 10 comprises a socket 14 for a crank pin 19, which has an elliptical cross section. The socket 14 is formed as a through hole 24 with a front and a back side 25, 26. The crank pin 19 arranged in the through hole 24 has a corresponding elliptical cross section. The pin section 21 of the crank pin 19 is arranged with distance from the minor axis of the elliptical cross section. The longitudinal axis of the elliptical through hole 24 and thus also of the elliptical crank pin 19, when the latter is introduced into the through hole 24, are oriented in radial direction of the flywheel 10.

The crank pin 19 can be introduced in two possible positions or orientations into the through hole 24. These two positions differ by 180° rotation around the central point of the elliptical cross section. Thus the distance 27 of the pin section 21 from the rotation axis 18 of the flywheel 10 varies as a function of whether the first or second position is selected. As a result of this design of the through hole 24 and the crank pin 19, it is possible, in one form, to produce two distances 27 of the pin section 21 and thus of the first end 16 of the push rod 6 from the rotation axis 18 of the flywheel 10.

As a result of the longitudinal extent of the crank pin 19 in the direction of the longitudinal axis of the elliptical cross section, a high twist-proofness of the crank pin 19 in the through hole 24 is guaranteed. This is particularly advantageous since, by means of the crank drive 10 and of the flywheel 6 attached thereto by means of the crank pin 19, large torque moments in general have to be converted into a linear force in translation direction of the roll stand, which leads to high stresses on the corresponding connecting elements and in particular on the crank pin 19.

FIG. 4*b* is a cross-sectional view of an embodiment according to the invention of a flywheel 10 with the crank pin 19 as shown in FIG. 4*a*. One can see the shape of the through hole 24 which is tapered backward in the direction of the rotation axis 18 of the flywheel 10 as well as the corresponding shape of the base body 20 of the crank pin 19. The central base body 20 here has a front and a back side 25, 26. A securing section 22 protrudes on the back side 26 out of the socket 14 of the flywheel 10 and it is secured with a securing element 23. As a result, the crank pin 19 is prevented from being pulled out of the through hole 24. The crank pin 19 is prevented from being pushed into the flywheel 10, over and beyond the position represented, by the tapering of the through hole 24 and the crank pin 19. In this way, the crank pin 19 is secured against shifting in all spatial directions, as well as against a twisting. In the represented embodiment, the securing element 23 is represented, for example, as a securing cotter, which is introduced into the crank pin through a through hole through the securing section 22 of the crank pin 19 perpendicular to the longitudinal axis of the crank pin 19 and is secured detachably against pulling out. However, other designs of corresponding securing elements 23 known from the prior art also conceivable as well, for example, a securing nut or securing screw, which can be connected via a corresponding thread connection to the crank pin 19, more precisely to its securing section 22.

For the purposes of the original disclosure, it is pointed out that all the features as they become apparent from the present description, the drawings and the dependent claims, to a person skilled in the art, even if they were described concretely only in connection with certain further features, can be combined both individually and also in any combination with other features or feature groups disclosed here, to the extent that this is not explicitly ruled out or technical circumstances make such combinations impossible or senseless. It is only for the sake of the brevity and readability of the description, that the summarized explicit representation of all the conceivable feature combinations and the stressing of the independence of the individual features from one another are omitted here.

LIST OF REFERENCE NUMERALS

1 Roll stand
2, 3 Rolls
4 Rolling mandrel
51, 52 Feeding clamping carriage
6 Push rod
7 Radial distance of the counterweight
8 Radial distance of the push rod
9 Counterweight
10 Crank drive
11 Hollow shell
14 Socket
15 Attachment device
16 First end of the push rod
17 Second end of the push rod
18 Rotation axis
19 Crank pin
20 Base body
21 Pin section
22 Securing section
23 Securing element
24 Through hole
25 Front side
26 Back side
27 Radial distance of the pin section
29 Driving wheel
38 Shortest distance between extreme position and reversal position
30 Central axis
31, 32 Clamping devices
41, 42 Chuck
60 Stainless steel tube
$E_1$ First extreme position
$E_2$ Second extreme position
$U_1$ First reversal position
$U_2$ Second reversal position

The invention claimed is:

1. A cold pilger rolling mill for forming a hollow shell into a tube, the cold pilger rolling mill comprising:

a pair of rolls rotatably attached to a roll stand;

a rolling mandrel tool;

a feeding clamping carriage for receiving the hollow shell, wherein during the operation of the mill, the feeding clamping carriage moves between a first and a second extreme position in such a manner that the hollow shell moves stepwise in a direction toward the tool;

a crank drive disposed on a driveshaft and rotatably mounted around a rotation axis;

a counterweight attached to the crank drive at a radial distance from the rotation axis; and a push rod having a first and a second end, the first end of the push rod being rotatably attached on the crank drive around a crank pin at a radial distance from the rotation axis, and wherein the second end of the push rod is attached to the roll stand, so that, during the operation of the mill, a rotation of the crank drive is converted into a translation movement of the roll stand between a first reversal point and a second reversal position, the radial distance of the first end of the push rod from the rotation axis being adjustable, so that a distance between the two reversal positions of the translation movement of the roll stand is adjustable, wherein the crank drive includes a through hole having a cross-section which is at least in some sections radially symmetric, but not rotationally symmetric, for receiving the crank pin, a base body with a front side and a back side, a pin section arranged on the front side and a securing section arranged on the back side, wherein the base body has a cross section, which at least in some sections is complementary to the cross-section of the through hole, so that the base body is received in a twist-proof manner and with positive lock in the through hole.

2. The cold pilger rolling mill according to claim 1, wherein the radial distance of the first end of the push rod from the rotation axis is adjustable in discrete steps or continuously.

3. The cold pilger rolling mill according to claim 2, wherein the crank drive includes a plurality of sockets for the crank pin for the attachment of the first end of the push rod, wherein the sockets are arranged at mutually different radial distances from the rotation axis.

4. The cold pilger rolling mill according to claim 1, wherein the through hole and the base body of the crank pin have at least in some sections an elliptical cross section.

5. The cold pilger rolling mill according to claim 4, wherein a major axis of the elliptical cross section of the through hole is oriented in radial direction of the crank drive.

6. The cold pilger rolling mill according to claim 4, wherein the pin section is arranged on the major axis at a distance from a minor axis of the elliptical cross section.

7. The cold pilger rolling mill according to claim 1, wherein the through hole is tapered in an axial direction and the base body has a tapering that is complementary to the taper of the through hole.

8. The cold pilger rolling mill according to claim 1, further comprising an attachment device for the detachable attachment of the counterweight.

9. The cold pilger rolling mill according to claim 8, wherein the crank drive includes a plurality of attachment devices for the detachable attachment of the counterweight, the attachment devices being arranged at mutually different radial distances from the rotation axis.

10. The cold pilger rolling mill according to, claim 1, wherein the radial distance of the counterweight from the rotation axis is adjustable, in discrete steps or continuously.

11. The cold pilger rolling mill according to claim 1, wherein a shortest distance between an extreme position of the feeding clamping carriage and a reversal position of the rolling stand is adjustable by adjusting the extreme position.

12. The cold pilger rolling mill according to claim 1, wherein the pin section is arranged eccentrically on the base body, so that the pin section can be arranged, by rotating the base body before the introduction into the through hole, at different radial distances from the rotation axis of the crank drive, wherein, on the pin section, the first end of the push rod is attached so that the push rod can be rotated around the longitudinal axis of the pin section, and wherein, on the securing section, a securing element is arranged, so that the crank pin is secured against being pulled out of the through hole.

13. A method for forming a hollow shell into a tube, comprising the steps of:

providing a cold pilger rolling mill having a pair of rolls rotatably attached to a roll stand, a rolling mandrel tool, and a feeding clamping carriage with the hollow shell received therein;

moving the feeding clamping carriage between a first extreme position and a second extreme position, such that the hollow shell moves stepwise in a direction toward the tool;

forming the hollow shell into the tube using the tool, wherein a rotation of a crank drive is converted into a translation movement of the roll stand between a first reversal position and a second reversal position, wherein the crank drive is rotatably mounted around a rotation axis on a driveshaft, a counterweight is attached at a radial distance from the rotation axis on the crank drive, and a push rod is arranged with a first and a second end so that the first end of the push rod is rotatably attached at a radial distance from the rotation axis around a crank pin on the crank drive and the second end of the push rod is attached to the roll stand; and adjusting the distance between the two reversal positions of the translation movement of the roll stand by adjusting the radial distance of the first end of the push rod from the rotation axis, wherein the crank drive has a through hole with a cross section that is at least in some sections radially symmetric but not rotationally symmetric for receiving the crank pin, the crank pin having a base body with a front side and a back side, a pin section being arranged on the front side and a securing section being arranged on the back side, wherein the base body has a cross section at least in some sections to be complementary to the cross section of the through hole, so that the base body can be received in a twist-proof manner and with positive lock in the through hole.

14. The method according to claim 13, wherein the pin section is arranged eccentrically on the base body, wherein, on the pin section, the first end of the push rod is attached so that the push rod can be rotated around the longitudinal axis of the pin section, wherein, on the securing section a securing element is arranged, so that the crank pin is secured against being pulled out, and wherein the step of the adjustment of the radial distance of the first end of the push rod from the rotation axis includes detaching the securing element, pulling the crank pin out of the through hole, rotating the crank pin around a longitudinal axis of the crank pin, reintroducing the crank pin into the through hole, and attaching the securing element.

* * * * *